US010053846B1

(12) United States Patent
Rim et al.

(10) Patent No.: US 10,053,846 B1
(45) Date of Patent: Aug. 21, 2018

(54) DISPOSABLE TOILET PLUNGER SHEATH AND TOILET PLUNGER INCLUDING THE SAME

(71) Applicants: Jeongwook Rim, Torrance, CA (US); Taewook Rim, Torrance, CA (US); Cheolwook Rim, Torrance, CA (US)

(72) Inventors: Jeongwook Rim, Torrance, CA (US); Taewook Rim, Torrance, CA (US); Cheolwook Rim, Torrance, CA (US)

( * ) Notice: Subject to any disclaimer, the term of this patent is extended or adjusted under 35 U.S.C. 154(b) by 0 days.

(21) Appl. No.: 15/591,118

(22) Filed: May 10, 2017

(30) Foreign Application Priority Data

Feb. 21, 2017 (KR) ..... 10-2017-0023083

(51) Int. Cl.
*E03C 1/308* (2006.01)
*E03D 11/00* (2006.01)

(52) U.S. Cl.
CPC ..... *E03C 1/308* (2013.01); *E03D 11/00* (2013.01)

(58) Field of Classification Search
CPC ..... E03C 1/308
USPC ..... 4/255.11
See application file for complete search history.

(56) References Cited

U.S. PATENT DOCUMENTS 2,668,974 A * 2/1954 Jaeger ..... A47K 11/10 15/210.1
5,149,159 A * 9/1992 Bardes ..... A41D 19/0075 294/1.3
5,226,182 A * 7/1993 Tucker ..... A61G 9/00 4/450
5,473,789 A * 12/1995 Oster ..... A47L 13/19 15/104.94
6,499,155 B1 * 12/2002 Barrios ..... E03D 5/02 221/310
6,594,831 B1 * 7/2003 Pardo ..... E03C 1/308 4/255.01
6,607,226 B1 * 8/2003 Poncy ..... A41D 19/0075 2/159
7,124,450 B2 * 10/2006 Davidson ..... E03D 9/00 4/255.11
7,281,278 B1 * 10/2007 Biagi ..... E03C 1/308 4/255.11
7,310,831 B2 12/2007 Duvall et al.
8,020,222 B2 * 9/2011 Falcon ..... A47K 17/00 4/255.01
8,020,223 B2 * 9/2011 Falcon ..... A47K 17/00 4/255.01
8,510,874 B2 * 8/2013 Duboc ..... E03D 9/00 4/255.11
9,970,186 B2 * 5/2018 Hodkiewicz ..... E03D 9/10
2004/0090073 A1 * 5/2004 Edwards ..... A47L 13/52 294/1.3
2006/0213791 A1 * 9/2006 Holden ..... A47K 17/00 206/349

(Continued)

*Primary Examiner* — Lori Baker
(74) *Attorney, Agent, or Firm* — Park, Kim & Suh, LLC

(57) ABSTRACT

A disposable toilet plunger sheath is configured to be used along with a toilet plunger for unclogging a clogged toilet or pipe. The toilet plunger includes a plunger handle and a plunger cup coupled to an end portion of the plunger handle. The disposable toilet plunger sheath is provided to the toilet plunger to prevent the toilet plunger from being contaminated during use of the toilet plunger. The toilet plunger further includes a container formed in the plunger handle and configured to contain the disposable toilet plunger sheath.

7 Claims, 6 Drawing Sheets

(56) References Cited

U.S. PATENT DOCUMENTS

| | | | | |
|---|---|---|---|---|
| 2009/0049593 | A1 | 2/2009 | Hodkiewicz et al. | |
| 2009/0196675 | A1* | 8/2009 | May | B29C 45/0081 401/206 |
| 2012/0066823 | A1* | 3/2012 | Lee | E03C 1/308 4/255.11 |
| 2013/0067650 | A1* | 3/2013 | Stein | E03C 1/308 4/255.11 |
| 2016/0309971 | A1* | 10/2016 | Gormeley | A47K 17/00 |
| 2016/0339166 | A1* | 11/2016 | Adam | A61M 3/0241 |

* cited by examiner

DISPOSABLE TOILET PLUNGER SHEATH AND TOILET PLUNGER INCLUDING THE SAME

CROSS-REFERENCE TO RELATED APPLICATIONS

This application claims priority from Korean Patent Application No. 10-2017-0023083, filed on Feb. 21, 2017, in the Korean Intellectual Property Office, the disclosure of which is incorporated herein by reference in its entirety.

BACKGROUND OF THE INVENTION

Field of the Invention

Apparatuses and methods consistent with the present invention relate to a disposable toilet plunger sheath and a toilet plunger including the same, and more particularly, to a disposable toilet plunger sheath for preventing a toilet plunger from being contaminated during use of a toilet plunger for unclogging a clogged toilet or pipe, and a toilet plunger including the disposable sheath.

Description of the Related Art

In general, a toilet plunger is mainly used as an instrument for unclogging a clogged toilet, pipe, or the like.

FIG. 1 is a diagram illustrating a general toilet plunger.

As illustrated in FIG. 1, a toilet plunger 1 includes a plunger handle 2 shaped like an elongated pole or rod and a plunger cup 3 coupled to an end portion of the plunger handle 2.

The plunger cup 3 is shaped like an approximate hemisphere including a predetermined cavity 4 formed therein with one open side and is formed of rubber.

Accordingly, when a user moves the plunger handle 2 up and down via piston motion, compressed air is generated as the inner cavity 4 of the plunger cup 3 repeatedly inflates and deflates and, accordingly, a clogged toilet or pipe is unclogged.

However, when the toilet plunger 1 is used, contaminants in the clogged toilet or pipe are discharged outside and the toilet plunger 1, in particular, the plunger cup 3 is significantly contaminated and, thus, it is inconvenient to wash the toilet plunger 1 after use.

In particular, when the toilet plunger 1 is not washed and is stored after use, it is not desirable for sanitary reasons and a nasty smell is generated and, thus, even if the toilet plunger 1 needs to be washed after use, it is very inconvenient and cumbersome to wash the toilet plunger 1 and, thus, the toilet plunger 1 is not frequently washed in reality.

As prior art, U.S. Pat. No. 7,310,831 discloses a disposable protection member for covering a toilet in order to prevent water from splashing around during use of the toilet plunger 1. In this regard, according to the prior art, the toilet plunger 1 is still contaminated and, thus, it is inconvenient to cleanly wash the toilet plunger 1 after use.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present invention provides a disposable toilet plunger sheath for preventing a toilet plunger from being contaminated when a clogged toilet or a pipe is unclogged using the toilet plunger, and a toilet plunger including the disposable sheath.

According to an aspect of the present invention, a toilet plunger for unclogging a clogged toilet or pipe includes a plunger handle, a plunger cup coupled to an end portion of the plunger handle, a disposable toilet plunger sheath for preventing the toilet plunger from being contaminated during use of the toilet plunger, and a container included in the plunger handle and configured to contain the disposable toilet plunger sheath, wherein the disposable toilet plunger sheath includes a cylindrical body including a sealed bottom portion and an open portion at an opposite side to the bottom portion, a bottom adhesive portion included in the bottom portion and affixed to an internal surface of the plunger cup during use of the toilet plunger, a tab extending from one side of the open portion, and an edge adhesive portion included in the tab and affixed to the plunger handle during use of the toilet plunger, and wherein the edge adhesive portion is affixed to the plunger handle after the cylindrical body is flipped to cover the plunger cup while the bottom adhesive portion is affixed to the internal surface of the plunger cup.

The sealed bottom portion may have a shape in proportion to a shape of an internal side of the plunger cup.

The bottom adhesive portion may be circular-shaped.

The cylindrical body may be formed in such a way that the open portion is wider than the bottom portion.

The container may be included in the plunger handle in a tubular form.

According to another aspect of the present invention, a disposable toilet plunger sheath that is contained in the container prior to use of the toilet plunger and is discarded after used from the container includes a cylindrical body including a sealed bottom portion and an open portion at an opposite side to the bottom portion, a bottom adhesive portion included in the bottom portion and affixed to an internal surface of the plunger cup during use of the toilet plunger, a tab extending from one side of the open portion, and an edge adhesive portion included in the tab and affixed to the plunger handle during use of the toilet plunger, wherein the edge adhesive portion is affixed to the plunger handle after the cylindrical body is flipped to cover the plunger cup while the bottom adhesive portion is affixed to the internal surface of the plunger cup.

BRIEF DESCRIPTION OF THE DRAWING FIGURES

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Figure 1:
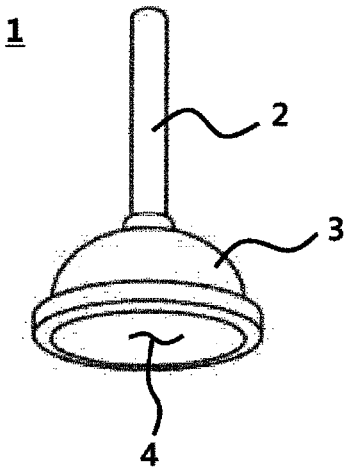
FIG. 1 is a diagram illustrating a general toilet plunger.

Hereinafter, exemplary embodiments of the present invention will be described in detail by explaining exemplary embodiments of the invention with reference to the attached drawings.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention.

In the drawings, the thicknesses of layers and regions are exaggerated for clarity. Accordingly, the present invention is not limited by the relative sizes and thicknesses illustrated in the accompanying drawings.

Figure 2:
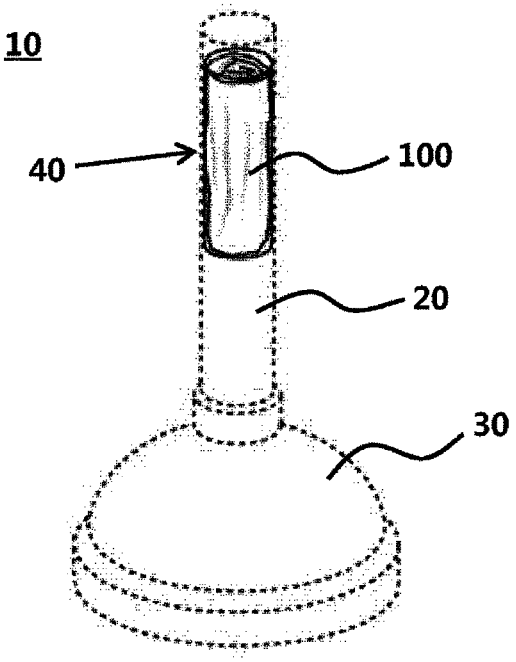
FIG. 2 is a diagram illustrating a toilet plunger according to an exemplary embodiment of the present invention.

FIG. 2 is a diagram illustrating a toilet plunger 10 according to an exemplary embodiment of the present invention.

Referring to FIG. 2, the toilet plunger 10 according to an exemplary embodiment of the present invention may include a plunger handle 20, a plunger cup 30 coupled to an end portion of the plunger handle 20, a disposable toilet plunger sheath (hereinafter, disposable sheath) 100, and a container 40 included in the plunger handle 20 and containing the disposable sheath 100.

The toilet plunger 10 according to the present invention may be used to unclog a clogged toilet or pipe, the plunger handle 20 may be shaped like an elongated pole or rod, and the plunger cup 30 may be shaped like an approximate hemisphere including a predetermined cavity 31 formed therein with one open side.

The plunger cup 30 may be formed of rubber such that the inner cavity 31 easily inflates and then deflates via up and down piston motion of the plunger handle 2.

However, the present invention is not limited to a detailed structure of the plunger handle 20 and the plunger cup 30 and may be applied to a structure of a generally and widely used toilet plunger.

The toilet plunger 10 configured above may generate compressed air as a user moves the plunger handle 2 up and down via piston motion such that the inner cavity 4 of the plunger cup 3 repeatedly inflates and deflates, that is, a plunging action is repeated and, accordingly, a clogged toilet or pipe is unclogged.

The disposable sheath 100 is a component for preventing the toilet plunger 10 from being contaminated during use of the toilet plunger 10 for unclogging a clogged toilet or pipe. In this regard, the disposable sheath 100 may be contained in the container 40 prior to use of the toilet plunger 10, may be taken out of the container 40 for use, and may be discarded after use, and a new disposable sheath 100 may be replenished in the container 40. A detailed structure of the disposable sheath 100 will be described below in detail.

The container 40 may be included in the plunger handle 20 shaped like an approximate rod and, for example, may be included in the plunger handle 20 in a tubular form so as to contain the disposable sheath 100 in a rolled state.

Figure 3:
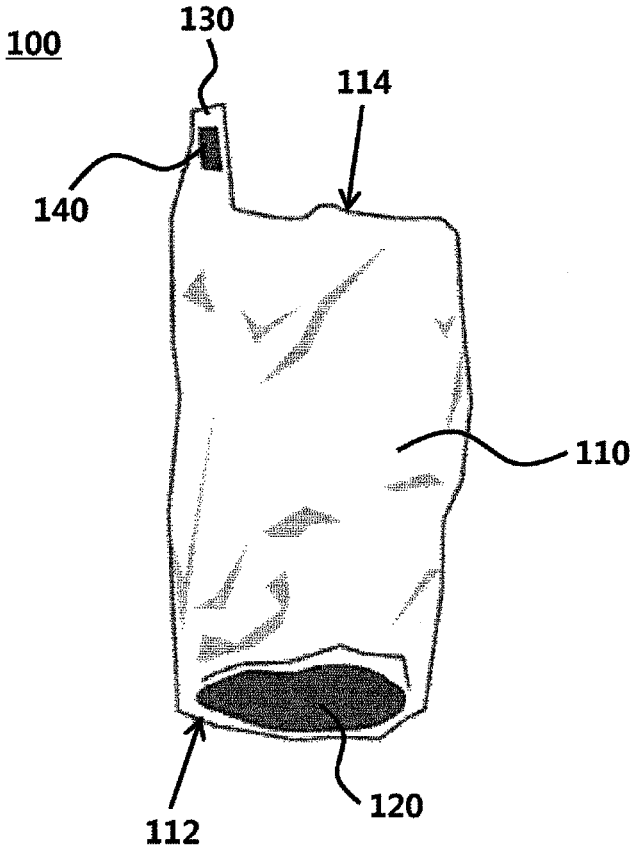
FIG. 3 is a diagram illustrating a disposable sheath according to an exemplary embodiment of the present invention.
Figure 4:
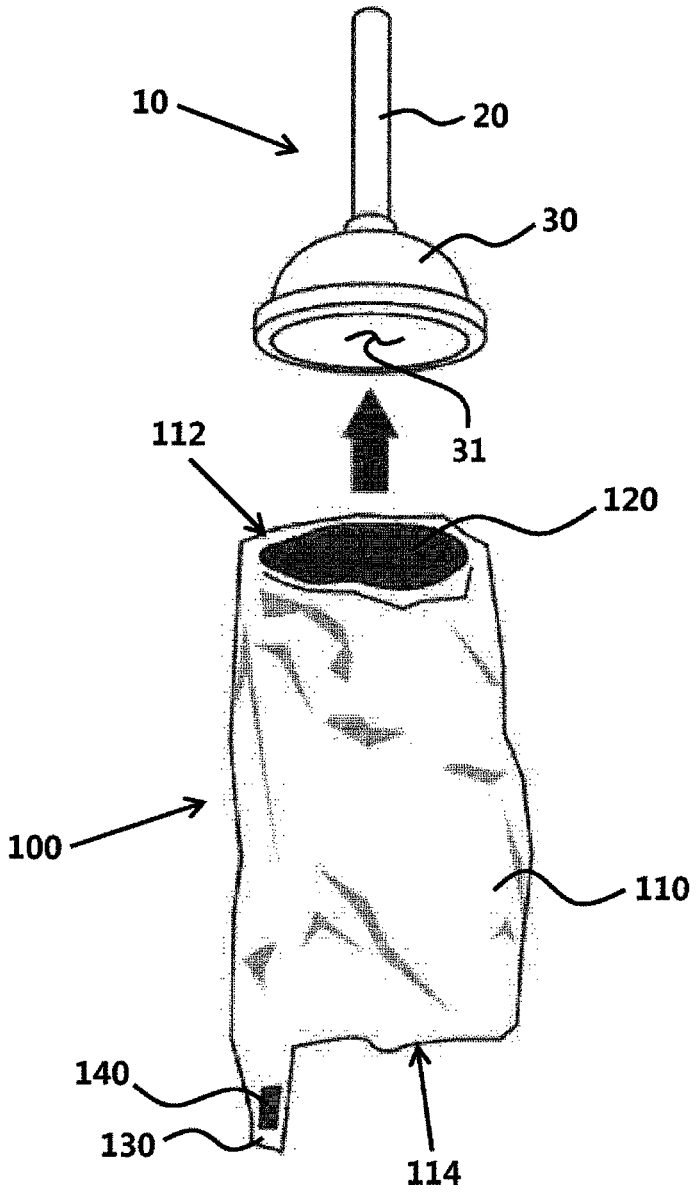
FIG. 4 is a diagram illustrating a state in which the disposable sheath illustrated in FIG. 3 is being affixed to a plunger prior to use of a toilet plunger.
Figure 5:
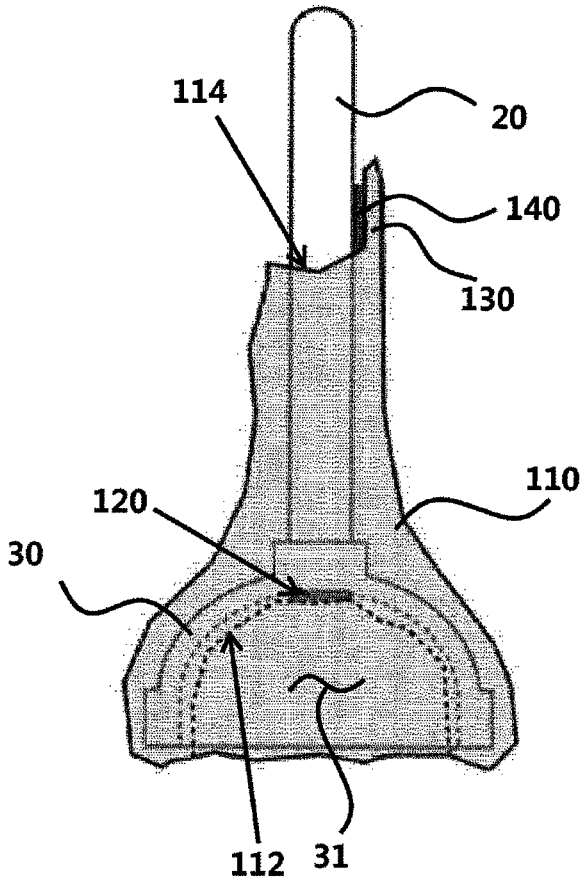
FIG. 5 is a diagram illustrating a state in which a disposable sheath is affixed to a toilet plunger.

FIG. 3 is a diagram illustrating a disposable sheath 100 according to an exemplary embodiment of the present invention, FIG. 4 is a diagram illustrating a state in which the disposable sheath 100 illustrated in FIG. 3 is being affixed to a plunger prior to use of the toilet plunger 10, and FIG. 5 is a diagram illustrating a state in which the disposable sheath 100 is affixed to the toilet plunger 10.

Referring to FIGS. 3 to 5, the disposable sheath 100 according to an exemplary embodiment of the present invention may be affixed to the toilet plunger 10 so as to entirely cover the plunger cup 30 prior to use of the toilet plunger 10 and the toilet plunger 10 may be used while the disposable sheath 100 is affixed to the toilet plunger 10.

In particular, the disposable sheath 100 may be affixed to the toilet plunger 10 such that an effective plunging action of the toilet plunger 10 occurs even in a state in which the disposable sheath 100 is affixed to the toilet plunger 10.

That is, the disposable sheath 100 may be affixed to the toilet plunger 10 and may entirely cover the plunger cup 30 during use of the toilet plunger 10 so as to prevent the toilet plunger 10 from being contaminated and may be configured in such a way that an effective plunging action of the toilet plunger 10 occurs even in a state in which the disposable sheath 100 is affixed to the toilet plunger 10.

In detail, the disposable sheath 100 may include a cylindrical body 110, a bottom adhesive portion 120, a tab 130, and an edge adhesive portion 140.

The cylindrical body 110 may include a sealed bottom portion 112 and an open portion at an opposite side to the bottom portion 112.

The bottom adhesive portion 120 may be included in the bottom portion 112 of the cylindrical body 110, the tab 130 may extend from one side of an open portion 114 of the cylindrical body 110, and the edge adhesive portion 140 may be included in the tab 130.

The bottom adhesive portion 120 may be affixed to an internal surface of the plunger cup 30 and the edge adhesive portion 140 may be affixed to the plunger handle 20 during use of the toilet plunger 10.

In particular, the edge adhesive portion 130 may be affixed to the plunger handle 20 after the cylindrical body 110 is flipped to cover the plunger cup 30 while the bottom adhesive portion 120 is affixed to an internal surface of the plunger cup 30.

Thus, the toilet plunger 10 may not be contaminated in use because the plunger cup 30 and the plunger handle 20 are partially covered by the cylindrical body 110 of the disposable sheath 100 and the cylindrical body 110 of the disposable sheath 100 may be flipped while the bottom adhesive portion 120 is affixed to the internal surface of the plunger cup 30 so as to cover the plunger cup 30 and, thus, a sufficient space may be formed at the internal surface of the plunger cup 30 such that an effective plunging action occurs.

The edge adhesive portion 140 is affixed to the plunger handle 20 while the cylindrical body 110 of the disposable sheath 100 entirely covers the plunger cup 30, thereby preventing the cylindrical body 110 from slipping down or preventing water or contamination from being introduced into the cylindrical body 110 during use of the toilet plunger 10.

The sealed bottom portion 112 of the cylindrical body 110 may have a shape in proportion to a shape of an internal side of the plunger cup 30. For example, the sealed bottom portion 112 of the cylindrical body 110 may be shaped like an approximate hemisphere that is a general shape of the plunger cup 30.

Then, when the bottom adhesive portion 120 is affixed to the internal surface of the plunger cup 30, a sufficient space is secured at an internal side of the plunger cup 30 and, thus, an effective plunging action may occur during use of the toilet plunger 10.

Similarly, the bottom adhesive portion 120 that is approximately circular-shaped may be included in the bottom portion 112 such that an effective plunging action occurs.

The cylindrical body 110 may be formed in such a way that the open portion 114 is wider than the bottom portion 112. Then, the cylindrical body 110 may be easily flipped to cover the plunger cup 30 while the bottom adhesive portion 120 is affixed to the internal surface of the plunger cup 30.

The cylindrical body 110 may be formed of an impermeable material so as to prevent the toilet plunger 10 from being contaminated during use of the toilet plunger 10 and, in particular, may be formed of resilient low-density polyethylene (LDPE) so as to prevent the sealed bottom portion 112 from being torn during the plunging action.

Figure 6:
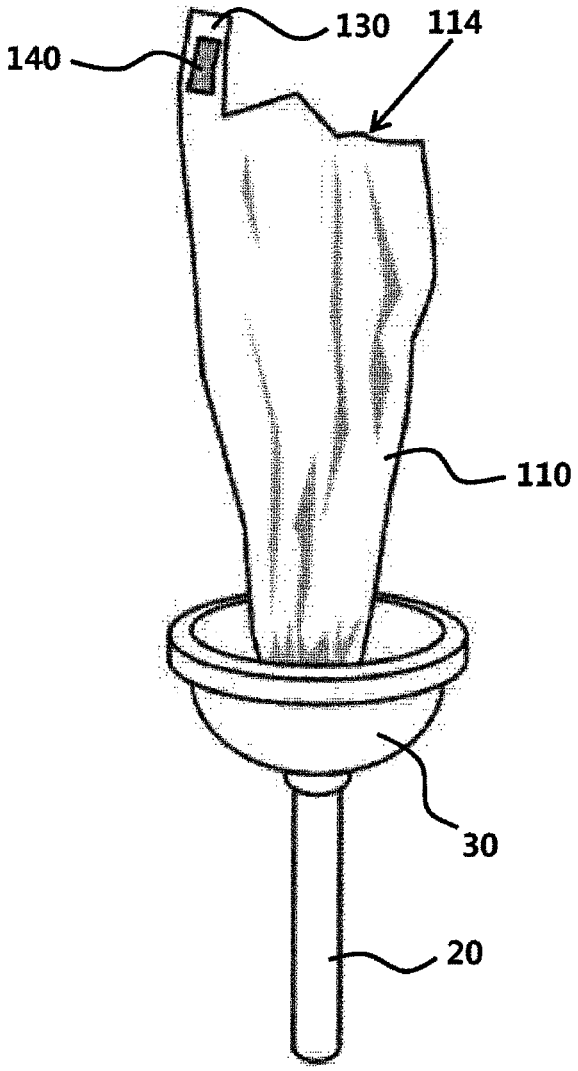
FIG. 6 is a diagram illustrating a state in which a disposable sheath is separated after use of the toilet plunger.
Figure 7:
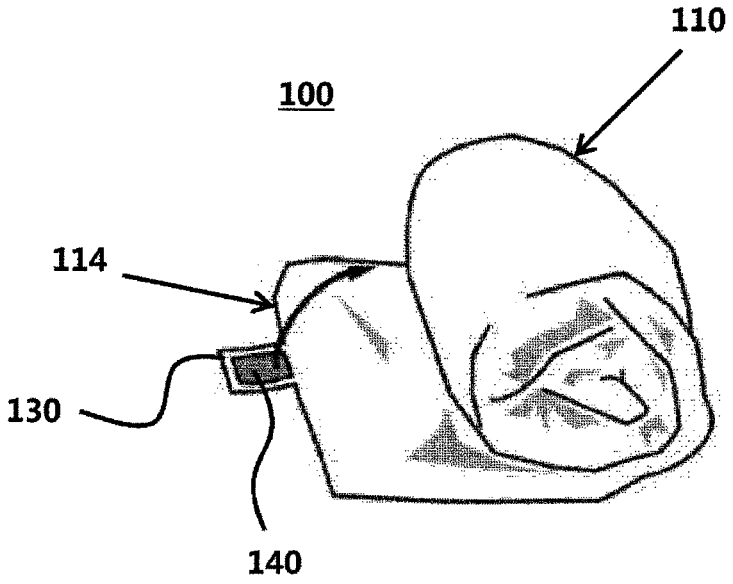
FIG. 7 is a diagram illustrating a state in which a disposable sheath separated from a toilet plunger 10 is rolled.

FIG. 6 is a diagram illustrating a state in which the disposable sheath 100 is separated after use of the toilet plunger 10. FIG. 7 is a diagram illustrating a state in which the disposable sheath 100 separated from the toilet plunger 10 is rolled.

As illustrated in FIG. 6, the disposable sheath 100 may be configured in such a way that, when the edge adhesive portion 140 is separated from the plunger handle 20 and then the cylindrical body 110 is flipped after use of the toilet plunger 10, contaminants on the cylindrical body 110 during use of the toilet plunger 10 are collected inside the cylindrical body 110.

As such, when contaminants are collected inside the cylindrical body 110 and then the bottom adhesive portion 120 is separated from the internal surface of the plunger cup 30, contaminants accumulated during use of the toilet plunger 10 may be separated from the toilet plunger 10 while being collected inside the cylindrical body 110.

Accordingly, when the disposable sheath 100 according to the present invention is used, it may be convenient that it is not necessary to separately wash the toilet plunger 10 after use.

The bottom adhesive portion 120 and the edge adhesive portion 140 may have weak adhesion so as to be easily affixed and separated and a strip may be coupled to each of the bottom adhesive portion 120 and the edge adhesive portion 140 so as to prevent foreign substances from being adhered thereto.

As illustrated in FIG. 7, the disposable sheath 100 that is separated after use of the toilet plunger 10 may be fixed using the edge adhesive portion 140 while being rolled and, thus, may be discarded in a compact state.

As described above, the present invention relates to a disposable toilet plunger sheath for preventing a toilet plunger from being contaminated during use of a toilet plunger for unclogging a clogged toilet or pipe, and a toilet plunger including the disposable sheath and various changes of exemplary embodiments of the present invention may be made. Accordingly, the foregoing exemplary embodiments are not to be construed as limiting the present invention and any type that is changeable by those skilled in the art is within the scope of the present invention.

According to an exemplary embodiment of the present invention, when the above disposable toilet plunger sheath is used, a toilet plunger may be used while the disposable toilet plunger sheath covers a plunger cup and a plunger handle and, thus, the toilet plunger may not be contaminated during use of the toilet plunger for unclogging a clogging toilet or pipe and it may be convenient that it is not necessary to separately wash the toilet plunger after use.

According to an exemplary embodiment of the present invention, when the above disposable toilet plunger sheath is used, a bottom adhesive portion may be flipped to cover a plunger cup while being affixed to an internal surface of the plunger cup and, thus, a sufficient inner cavity of the plunger cup may be secured and a plunging action for unclogging a clogged toilet or pipe may effectively occur.

In particular, a cylindrical body that is flipped to cover a plunger cup may be fixed to be affixed to a plunger handle by an edge adhesive portion, thereby preventing the cylindrical body from slipping down or preventing contaminants from being introduced into the cylindrical body during use of the toilet plunger.

According to an exemplary embodiment of the present invention, when the above disposable toilet plunger sheath is used, each of a bottom adhesive portion and an edge adhesive portion may be affixed to and then separated from a plunger cup and a plunger handle so as to be easily affixed to and separated from the toilet plunger and, in particular, the disposable sheath may be fixed to be rolled by the edge adhesive portion while contaminants are collected inside a cylindrical body after the disposable toilet plunger sheath is separated and, thus, may be discarded in a compact state.

According to an exemplary embodiment of the present invention, when the above disposable toilet plunger sheath is used, a disposable toilet plunger sheath for preventing a toilet plunger from being contaminated during use of the toilet plunger may be contained in a plunger handle and may be replenished and, thus, it may be convenient that a user is capable of easily using the disposable toilet plunger sheath anytime.

It will be appreciated by persons skilled in the art that that the effects that could be achieved with the present invention are not limited to what has been particularly described hereinabove and other advantages of the present invention will be more clearly understood from the above detailed description taken in conjunction with the claims and the descriptions.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A toilet plunger for unclogging a clogged toilet or pipe, comprising:

a plunger handle;

a plunger cup coupled to an end portion of the plunger handle;

a disposable toilet plunger sheath for preventing the toilet plunger from being contaminated during use of the toilet plunger; and a container included in the plunger handle and configured to contain the disposable toilet plunger sheath, wherein the disposable toilet plunger sheath comprises:

a cylindrical body comprising a sealed bottom portion and an open portion at an opposite side to the bottom portion;

a bottom adhesive portion disposed on the bottom portion and attached to an internal surface of the plunger cup during use of the toilet plunger;

a tab extending from one side of the open portion; and an edge adhesive portion disposed on the tab and comprising adhesive material, the edge adhesive portion being attached to the plunger handle such that the cylindrical body is prevented from being separated from the plunger handle during use of the toilet plunger; and wherein the toilet plunger sheath separated from the toilet plunger is rolled and the edge adhesive portion is attached to the rolled toilet plunger sheath to maintain a rolled state thereof after the use of the toilet plunger, such that the toilet plunger sheath is able to be easily discarded in a disposable form.

2. The toilet plunger according to claim 1, wherein the sealed bottom portion has a shape in proportion to a shape of an internal side of the plunger cup.

3. The toilet plunger according to claim 2, wherein the bottom adhesive portion is circular-shaped.

4. The toilet plunger according to claim 1, wherein the cylindrical body is formed in such a way that the open portion is wider than the bottom portion.

5. The toilet plunger according to claim 1, wherein the container is included in the plunger handle in a tubular form.

6. The toilet plunger according to claim 1, wherein the bottom adhesive portion is first attached to the internal surface of the plunger cup while the bottom adhesive portion is exposed outside the toilet plunger sheath, the cylindrical body is flipped to cover the plunger cup and the plunger handle, and the edge adhesive portion is attached to the plunger handle, such that the toilet plunger sheath covers the toilet plunger before the use of the toilet plunger.

7. The toilet plunger according to claim 6, wherein in order to separate the toilet plunger sheath from the toilet plunger after the use of the toilet plunger, the edge adhesive portion is first detached from the plunger handle, the cylindrical body is reversely flipped to uncover the plunger cup and the plunger handle while contaminants on the toilet plunger sheath are collected inside the reversely flipped cylindrical body, and the bottom adhesive portion is detached from the plunger cup.

* * * * *